US009812831B2

(12) United States Patent
Zanotto et al.

(10) Patent No.: US 9,812,831 B2
(45) Date of Patent: Nov. 7, 2017

(54) CONNECTOR FOR LIGHTING DEVICES AND CORRESPONDING METHOD

(71) Applicant: OSRAM GmbH, Munich (DE)

(72) Inventors: Alberto Zanotto, Padua (IT); Simon Bobbo, Mirano (IT); Valerio Michielan, Scorzè (IT)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 15/164,933

(22) Filed: May 26, 2016

(65) Prior Publication Data

US 2016/0365688 A1 Dec. 15, 2016

(30) Foreign Application Priority Data

Jun. 11, 2015 (IT) ..... 102015000022700

(51) Int. Cl.

| | |
|---|---|
| ***H01R 4/24*** | (2006.01) |
| ***H01R 4/26*** | (2006.01) |
| ***H01R 11/20*** | (2006.01) |
| ***H01R 25/14*** | (2006.01) |
| ***H01R 11/11*** | (2006.01) |
| ***H01R 13/24*** | (2006.01) |
| ***F21S 4/20*** | (2016.01) |
| ***F21V 21/002*** | (2006.01) |
| *H01R 13/73* | (2006.01) |

(Continued)

(52) U.S. Cl.

CPC ..... *H01R 25/142* (2013.01); *F21S 4/20* (2016.01); *F21V 21/002* (2013.01); *H01R 11/11* (2013.01); *H01R 13/24* (2013.01); *F21V 23/06* (2013.01); *F21Y 2103/10* (2016.08); *F21Y 2115/10* (2016.08); *H01R 13/73* (2013.01)

(58) Field of Classification Search

CPC ..... F21V 23/06; F21V 21/002; F21V 21/005; F21L 4/02; H01R 12/721; H01R 13/20

USPC ..... 439/78, 422, 425, 426

See application file for complete search history.

(56) References Cited

U.S. PATENT DOCUMENTS 4,900,264 A * 2/1990 Bennett ..... H01R 12/592 439/391
4,975,080 A * 12/1990 Daly ..... H01R 12/613 29/866

(Continued)

FOREIGN PATENT DOCUMENTS

EP 2584248 A2 4/2013
JP 2007157408 A 6/2007

OTHER PUBLICATIONS

Italian Search Report based on Application No. 102015000022700 (7 pages) dated Dec. 16, 2015 (Reference Purpose Only).

*Primary Examiner* — Hae Moon Hyeon

(74) *Attorney, Agent, or Firm* — Viering, Jentschura & Partner mbB

(57) ABSTRACT

In various embodiments, a connector for lighting devices including an elongate planar support member having a front surface with electrically conductive lines and at least one electrically-powered light radiation source thereon, is provided. The connector includes a C-shaped body having a web portion and two side portions, said C-shaped body locatable astride said planar support member with said web portion facing said front surface, and electrical contact means extending from said web portion between said side portions configured to contact electrically conductive lines on said front surface of said planar support member.

12 Claims, 2 Drawing Sheets

(51) Int. Cl.

| | |
|---|---|
| *F21Y 103/10* | (2016.01) |
| *F21Y 115/10* | (2016.01) |
| *F21V 23/06* | (2006.01) |

(56) References Cited

U.S. PATENT DOCUMENTS

| | | | | |
|---|---|---|---|---|
| 6,196,863 | B1 * | 3/2001 | Schwant | H01R 12/67 439/417 |
| 6,544,068 | B1 * | 4/2003 | Hatton | F21V 21/002 429/209 |
| 7,704,094 | B2 * | 4/2010 | Sato | H01R 12/675 439/422 |
| 9,239,136 | B1 * | 1/2016 | Petersen | H01R 13/62 |
| 2006/0197474 | A1 * | 9/2006 | Olsen | H05B 33/0821 315/312 |
| 2008/0153344 | A1 | 6/2008 | Horst et al. | |
| 2013/0012068 | A1 | 1/2013 | Naito et al. | |
| 2015/0241035 | A1 * | 8/2015 | Dankelmann | F21V 21/005 362/219 |
| 2015/0369459 | A1 * | 12/2015 | Huang | F21V 17/101 362/311.02 |

* cited by examiner

CONNECTOR FOR LIGHTING DEVICES AND CORRESPONDING METHOD

CROSS-REFERENCE TO RELATED APPLICATION

This application claims priority to Italian Patent Application Serial No. 102015000022700, which was filed Jun. 11, 2015, and is incorporated herein by reference in its entirety.

TECHNICAL FIELD

Various embodiments relate generally to lighting devices.

One or more embodiments may find application in lighting devices employing electrically powered light radiation sources, e.g. solid-state light radiation sources, such as Light Emitting Diode (LED) sources.

BACKGROUND

In the sector of lighting applications, certain solutions envisage LED modules including an elongate planar support member (e.g. a flexible ribbon-shaped support) having a front face carrying one or more light radiation sources (e.g. LED sources) as well as the electrically conductive lines associated thereto.

In order to obtain the electrical contact with said electrically conductive lines (e.g. in order to supply power to light radiation sources, and optionally to perform "smart" control function), various connectors may be used.

Such connectors may be mounted at the end edges of the module.

Mounting the connector at an end position may be disadvantageous e.g. when the module must be mounted with one or both extremities at corner positions, e.g. between two converging walls: in such conditions the extremity of the lighting module is located at an edge position within the dihedral angle formed by the walls.

Moreover, the connector may be rather bulky, and therefore it may originate, with respect to the lower (i.e. rear) surface of the module, a sort of "step", which may impose limitations as regards mounting the lighting device onto a substrate, e.g. a heatsink.

Especially in the case of power modules (e.g. high-flux LEDs), the connector thickness may be an obstacle to the thermal coupling between the lighting device and the heatsink on which it is mounted, especially as regards the previously mentioned step or gap which may be located underneath the module. This may impose the creation of a cavity (e.g. a groove) adapted to receive the portion of the connector which protrudes from the surface of the lighting module, in order to achieve an effective thermal contact with the heatsink.

SUMMARY

In various embodiments, a connector for lighting devices including an elongate planar support member having a front surface with electrically conductive lines and at least one electrically-powered light radiation source thereon, is provided. The connector includes a C-shaped body having a web portion and two side portions, said C-shaped body locatable astride said planar support member with said web portion facing said front surface, and electrical contact means extending from said web portion between said side portions configured to contact electrically conductive lines on said front surface of said planar support member.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

In the following description, numerous specific details are given to provide a thorough understanding of embodiments. One or more embodiments may be practiced without one or several specific details, or with other methods, components, materials, etc. In other instances, well-known structures, materials or operations are not shown or described in detail to avoid obscuring various aspects of the embodiments. The need is therefore felt to provide solutions adapted to overcome the previously outlined drawbacks.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments.

The headings provided herein are for convenience only, and therefore do not interpret the extent of protection or scope of the embodiments.

One or more embodiments aim at satisfying such a need.

One or more embodiments provide a connector having the features specifically set forth in the claims that follow.

One or more embodiments may also refer to a corresponding method.

The claims are an integral part of the technical teaching provided herein with reference to the embodiments.

One or more embodiments allow for the application of a connector practically at any position along the length of the lighting device, e.g. at the locations carrying contact formations such as connecting pads of the electrically conductive lines of the device. In this way no step or gap is formed between the lighting device and the surface of a substrate (e.g. a heatsink) on which the device is mounted.

One or more embodiments are compatible with a wide range of lighting devices, e.g. both rigid and flexible light emitting diode (LED) modules, which may be optionally provided with ingress protection (IP grade).

One or more embodiments may offer one or more of the following effects:

- the possibility of implementing the electrical connection practically at any point of the lengthwise extension of the lighting device;

an optimized thermal dissipation, the possibility being given of a full contact of the lighting device with a mounting surface, e.g. of a heatsink;

the possibility of conferring the connector a tensile strength, as required by safety regulations;

the reduction of the overall dimensions of the connector, even in the case of IP-protected lighting devices;

a safe and reliable electrical and mechanical connection throughout the lifetime of the lighting device.

Figure 1:
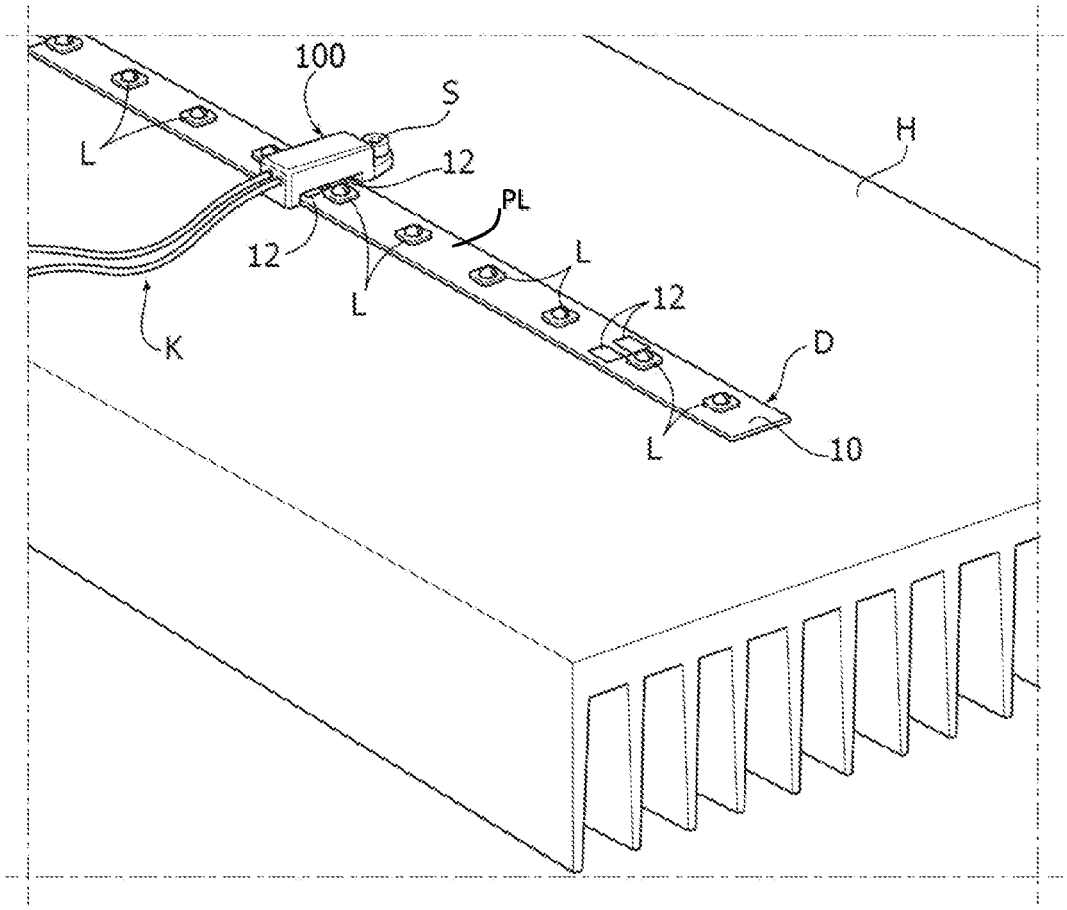
FIG. 1 generally shows the uses of one or more embodiments.

FIG. 1 is a perspective view showing the possible mounting of a lighting device D onto a substrate H adapted to include e.g. a heatsink, having a planar front face (on which lighting device D is to be arranged) and a finned back surface.

Heatsink H shown herein generally represents the possibility of mounting lighting device D on any substrate H, e.g. a planar substrate.

Lighting device D may include, e.g., a lighting device employing electrically powered light radiation sources. The latter may be for example solid-state light radiation sources, such as light emitting diode (LED) sources, which are distributed, e.g. in a linear array, on a elongate planar support member 10.

On the front surface of support member 10 there may be provided electrically conductive lines, in order to supply power to sources L (and optionally in order to perform "smart" control functions such as dimming, thermal management, tuning of the colour or colour temperature of the emitted radiation, etc.).

Said electrically conductive lines are not visible in FIG. 1, with the exception of the possible presence of contact formations 12 such as pads, adapted to be variously arranged along the length of support member 10.

The embodiments however are not restricted to any mandatory presence of such pads. As a matter of fact, connector 100 according to one or more embodiments is adapted to be coupled to lighting device D at any location along the length thereof, wherever it may be possible to establish an electrical contact with the conductive lines associated to sources L.

As visible in the Figures, in one or more embodiments connector 100 may include a body 102 having in general a C-shape (or a U-shape, i.e. the shape of a portal or inverted channel) consisting of a web portion or branch 102*a* and two side portions or branches 102*b* (e.g. of equal length) which finish off the C-shape.

Such a C-shaped configuration allows for the arrangement, as exemplified in FIG. 1, of the connector 100 astride elongate support member 10 of device D.

Figure 5:
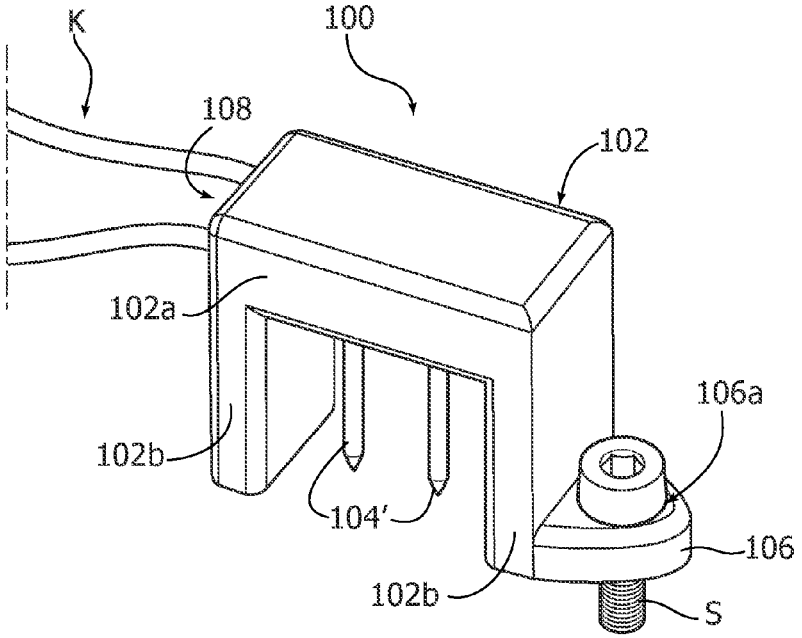
FIG. 5 shows a modification of one or more embodiments.

The web portion 102*a* of body 102 supports one or more (e.g. two) electrical contacts which extend inwardly of the C-shape or channel shape, and which may consist of resilient sliding contacts 104 (FIG. 2) or piercing pins 104' (FIG. 5).

As shown in FIG. 1, when connector 100 is located astride or bridge-like on device D, contact(s) 104, 104' may contact electrically conductive lines (e.g. conductive contact formations 12) provided on support 10, so as to implement the electrical contact of such electrically conductive lines with corresponding electrical wires or cables K, connected to connector 100.

Figure 2:
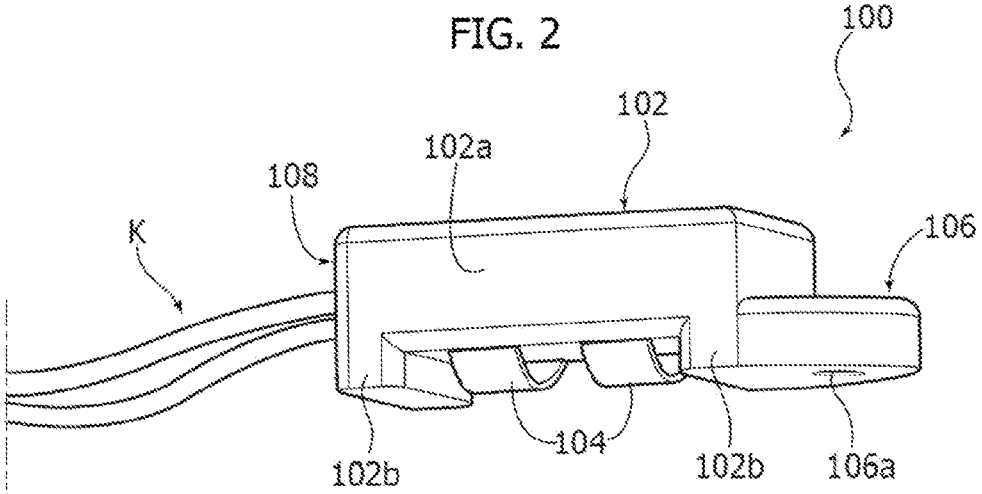
FIGS. 2 and 3 show are perspective views of a connector according to embodiments.

In the case of resilient sliding contacts, such as contacts 104 in FIG. 2, the contact takes place on the surface, optionally with an elastic load.

In the case of pins 104', the surface electrical contact is supplemented by a piercing of support member 10, which strengthens the mechanical connection of connector 100 to device D.

It will be seen, moreover, that electrical contacts such as resilient sliding contacts 104 in FIG. 2, which may extend from web portion or branch 102*a* between side portions 102*b* of the body of connector 100, may be carried either by web portion 102*a* (because they are mounted thereon), or by side portions 102 according to a general cantilever configuration. Such electrical contacts may in any case extend with respect to web portion 102*a*, in order to contact the electrically conductive lines on the front surface of planar support member 10.

Reference 106 denotes a cantilever formation projecting from body 102 and adapted to act as a fixing formation, in order to fix connector 100 onto a substrate (e.g. the front face of heatsink H), lighting device D (or specifically laminar support member 10) being sandwiched between connector 100 and substrate H.

In this way, in one or more embodiments, connector 100 is adapted to perform, in addition to the electrical contact of device D, also a mechanical fixation action of lighting device D on a substrate H.

For example, in one or more embodiments, the fixing formation 106 may be provided with an aperture 106*a* for the passage of a screw or pin (or of a similar fixation member) S which can be fitted, e.g. by a screw connection, into a corresponding hole (not visible in the Figures) of substrate H.

In one or more embodiments, as exemplified in the Figures, fixing formation 106 may be a formation protruding from C-shaped body 102 of connector 100; it will be appreciated, however, that in one or more embodiments there may be provided a plurality of fixing formations of this kind.

In one or more embodiments, as exemplified in the Figures, fixing formation 106 may be located at one of side portions 102*b* of body 102 of connector 100.

In one or more embodiments, as exemplified in the Figures, fixing formation 106 may be located in a position/in a region of body 102 of connector 100 opposed to the position/the region of said body adapted for the passage of cables K entering 108 connector 100, e.g. provided with one or more apertures not visible in the Figures.

This arrangement on opposed sides simplifies the mounting of connector 100 onto substrate H, e.g. while preventing the insertion (and, if necessary, the tightening) of fixing member S from originating interferences with cables K or vice versa.

One or more embodiments therefore may bring about both an electrical and a mechanical contact.

As exemplified in FIG. 1, in one or more embodiments such a mechanical connection, in addition to mechanically connecting connector 100 to device D, also provides the mechanical fixation of lighting device D onto substrate H, support member 10 being sandwiched between connector 100 (web portion 102*a*) and substrate H.

Embodiments as exemplified in FIG. 5 may simplify the use of IP-protected lighting devices (which e.g. are provided with sealing layers and/or with a covering sheath of materials such as silicone). Indeed, thanks to their sharp shape, pins 104' may pierce the protective layer PL of lighting device D in order to contact electrically conductive lines on the front surface of support member 10.

Whatever the implementation of electrical contact means 104, 104' may be, in one or more embodiments there may be provided a surface finishing (e.g. gold) of the contacts. Contacts 104, 104' may also be subjected to other finishing treatments (e.g. ImAg, immersion tin plating, OSP, etc.).

As for the materials used to form body or case 102, which may be shaped as a hollow shell, in one or more embodiments plastic materials may be used, such as polycarbonate (e.g. Bayer Makrolon® 2447).

One or more embodiments may therefore offer features such as high mechanical strength (e.g. adapted to withstand impact tests >IK 10), resistance to high temperatures (even higher than 150° C.), reliability (as already shown in automotive applications), resistance to environmental agents such as UV radiation (which is important for outdoor applications).

Connector 100 may be implemented with a small size, so as not to interfere appreciably with the radiations emitted by sources L, thus avoiding shadow areas or areas with reduced brightness.

It will be appreciated, moreover, that one or more embodiments enable the mechanical connection of lighting device D to a substrate H while avoiding the appearance of steps or gaps, so as to keep the whole extension of lighting device D in contact (e.g. thermal exchange contact) with substrate H, especially when the latter includes a heatsink.

Figure 3:
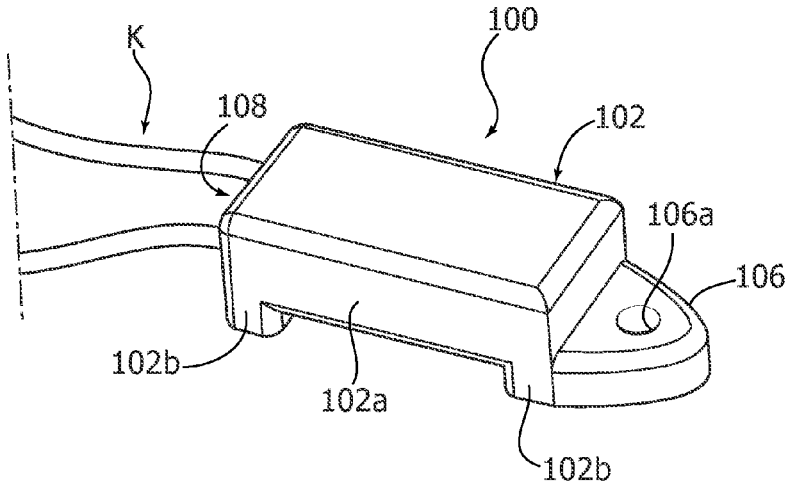
Figure 4:
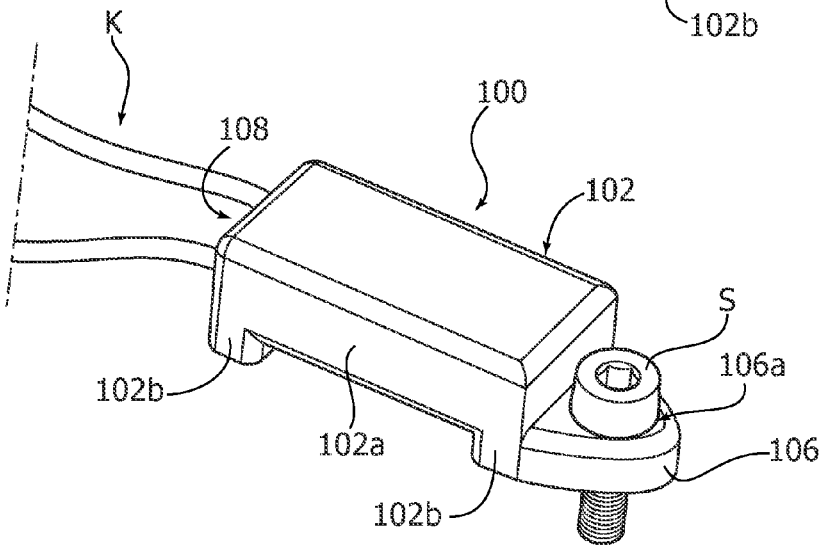
FIG. 4 shows is a further perspective view of a connector according to embodiments.

A comparison of FIG. 5 with FIG. 2 to FIG. 4 highlights the fact that the length of side portions 102*b* of body 102 of connector 100 may be chosen while taking into account the thickness of device D, e.g. of the planar support member 10 and/or of optional protective layers PL or sheaths.

One or more embodiments as exemplified in FIG. 5, adapted to be used with IP-protected devices D, may have side portions 102*b* which are longer than those shown in FIG. 2 to FIG. 4, so as to take into account the increased thickness of an IP-protected lighting device D in comparison with the "bare" device exemplified in FIG. 1; in this way a connector 100 may be used as exemplified in FIG. 2 to FIG. 4, i.e. with side portions 102*b* having a length substantially equal to the thickness of laminar support member 10.

As regards the exemplified fixation solutions, e.g. in FIG. 1, FIG. 4 and FIG. 5, it will be appreciated moreover that a member S, adapted to traverse hole 106*a* and the receiving hole provided in substrate H, is adapted to ensure a retention force of lighting device D on substrate H which complies with safety regulations.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A connector for lighting devices comprising an elongate planar support member having a front surface with electrically conductive lines and at least one electrically-powered light radiation source thereon, wherein said lighting devices are IP-protected lighting devices provided with a protective layer, the connector comprising:

a C-shaped body having a web portion and two side portions, said C-shaped body locatable astride said planar support member with said web portion facing said front surface, and electrical contact means extending from said web portion between said side portions, wherein said electrical contact means is comprised of at least one piercing pin configured to pierce said protective layer and to contact electrically conductive lines on said front surface of said planar support member.

2. The connector of claim 1, wherein said electrical contact means are resilient.

3. The connector of claim 2, wherein said electrical contact means are elastic.

4. The connector of claim 1, wherein said electrical contact means are carried by said web portion of the connector body.

5. The connector of claim 1, further comprising:

at least one fixing formation configured to fix said connector on a substrate with said planar support member sandwiched between the connector and said substrate.

6. The connector of claim 5, wherein said at least one fixing formation includes at least one protrusion with an aperture therein.

7. The connector of claim 6, wherein said protrusion protrudes externally of the connector body.

8. The connector of claim 5, wherein said at least one fixing formation is arranged at one of said side portions of the connector body.

9. The connector of claim 8, further comprising:

an ingress region for at least one electric wire toward said electrical contact means, wherein said at least one fixing formation and said ingress region are arranged at the one and the other of said side portions of the connector body, respectively.

10. The connector of claim 1, wherein said electrical contact means include a plurality of electrical contacts.

11. A method of providing electrical connection to a lighting device including an elongate planar support member having a front surface with electrically conductive lines and at least one electrically-powered light radiation source thereon, wherein said lighting device is IP-protected lighting device provided with a protective layer, the method including:

providing a connector, the connector comprising:

a C-shaped body having a web portion and two side portions, said C-shaped body locatable astride said planar support member with said web portion facing said front surface, and electrical contact means extending from said web portion between said side portions configured to contact electrically conductive lines on said front surface of said planar support member, arranging said connector astride said elongate planar support member with said web portion facing said front surface and said electrical contact means, wherein said electrical contact means include at least one piercing pin;

piercing the protective layer with the piercing pin; and contacting electrically conductive lines on said front surface of said planar support member.

12. A lighting system comprising:

a connector for lighting devices comprising an elongate planar support member having a front surface with electrically conductive lines and at least one electrically-powered light radiation source thereon, wherein said lighting devices are IP-protected lighting devices provided with a protective layer, the connector comprising:

a C-shaped body having a web portion and two side portions, said C-shaped body locatable astride said planar support member with said web portion facing said front surface, and electrical contact means extending from said web portion between said side portions, wherein said electrical contact means is comprised of at least one piercing pin configured to pierce said protective layer and to contact electrically conductive lines on said front surface of said planar support member;

wherein the support member is positioned on a substrate between the connector and the substrate.

* * * * *